US005720043A

United States Patent [19]

White, Sr.

[11] Patent Number: 5,720,043

[45] Date of Patent: Feb. 24, 1998

[54] CONVERTIBLE BEACH TOWEL AND PONCHO

[76] Inventor: Marvin D. White, Sr., 2401 Princess Anne St., Fredericksburg, Va. 22401

[21] Appl. No.: 786,777

[22] Filed: Jan. 21, 1997

[51] Int. Cl.[6] ..... A41D 3/08

[52] U.S. Cl. ..... 2/69; 2/88

[58] Field of Search ..... 2/69, 88, 69.5, 2/89, 94

[56] References Cited

U.S. PATENT DOCUMENTS

| | | | |
|---|---|---|---|
| 1,901,223 | 3/1933 | Bush | 2/88 |
| 2,024,044 | 12/1935 | Johnson | 2/88 |
| 2,302,844 | 11/1942 | Ebbott | 2/88 |
| 2,344,010 | 3/1944 | Walsh | 2/88 |
| 2,420,344 | 5/1947 | Alexander | 2/69 |
| 3,013,274 | 12/1961 | Dike | 2/69 |
| 3,079,611 | 3/1963 | Boryszewski | 2/89 |
| 4,180,867 | 1/1980 | Ridgeway | 2/89 |
| 5,054,127 | 10/1991 | Zevchak | 2/69 |

FOREIGN PATENT DOCUMENTS

| | | | |
|---|---|---|---|
| 625095 | 8/1927 | France | 2/88 |
| 300885 | 11/1928 | United Kingdom | 2/88 |
| 1022065 | 3/1966 | United Kingdom | 2/88 |

*Primary Examiner*—Gloria Hale

[57] ABSTRACT

A convertible beach towel and poncho including a piece of cloth having a circular and essentially planar configuration. The piece of cloth has a large aperture through a central portion thereof. A cover member is also included having a circular and essentially planar configuration. The cover member is dimensioned for removable coupling with the large aperture. The cover member can be moved to expose the large aperture to allow for the device to be worn as a poncho or it can be attached around the large aperture to allow the device to be used as a beach towel.

3 Claims, 4 Drawing Sheets

CONVERTIBLE BEACH TOWEL AND PONCHO

BACKGROUND OF THE INVENTION

1. Field of the Invention

The present invention relates to a convertible beach towel and poncho and more particularly pertains to converting a wearable poncho for use as a beach towel for use on a beach with a convertible beach towel and poncho.

2. Description of the Prior Art

The use of beach towel is known in the prior art. More specifically, beach towel heretofore devised and utilized for the purpose of laying on at a beach are known to consist basically of familiar, expected and obvious structural configurations, notwithstanding the myriad of designs encompassed by the crowded prior art which have been developed for the fulfillment of countless objectives and requirements.

In this respect, the convertible beach towel and poncho according to the present invention substantially departs from the conventional concepts and designs of the prior art, and in doing so provides an apparatus primarily developed for the purpose of converting a wearable poncho for use as a beach towel for use on a beach.

Therefore, it can be appreciated that there exists a continuing need for new and improved convertible beach towel and poncho which can be used for converting a wearable poncho for use as a beach towel for use on a beach. In this regard, the present invention substantially fulfills this need.

SUMMARY OF THE INVENTION

In the view of the foregoing disadvantages inherent in the known types of beach towel now present in the prior art, the present invention provides an improved convertible beach towel and poncho. As such, the general purpose of the present invention, which will be described subsequently in greater detail, is to provide a new and improved convertible beach towel and poncho and method which has all the advantages of the prior art and none of the disadvantages.

To attain this, the present invention essentially comprises a piece of cloth having a circular and essentially planar configuration. The piece of cloth has an exterior surface and an interior surface. The piece of cloth has a large aperture through a central portion thereof. The large aperture is concentrically positioned with respect to the piece of cloth. The large aperture has a diameter less than ⅕ of a diameter of the piece of cloth. The large aperture has a plurality of male snap fasteners disposed around a peripheral edge thereof. The device includes a cover member having a circular and essentially planar configuration. The cover member is dimensioned for coupling with the large aperture. The cover member has an outer periphery with a segment thereof secured to the peripheral edge of the large aperture. The outer periphery has a plurality of female fasteners disposed therearound for selective snap engagement with the male snap fasteners of the large aperture. A pillow is adapted for removable coupling with the exterior surface of the piece of cloth adjacent to the large aperture. A plurality of pouches are secured to the exterior surface of the piece of cloth. The plurality of pouches are disposed in a spaced relationship around the piece of cloth. Each of the pouches have snap fasteners for selective closure thereof. A towel is removably secured to the exterior surface of the piece of cloth.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved convertible beach towel and poncho which has all the advantages of the prior art beach towel and none of the disadvantages.

It is another object of the present invention to provide a new and improved convertible beach towel and poncho which may be easily and efficiently manufactured and marketed.

It is a further object of the present invention to provide a new and improved convertible beach towel and poncho which is of durable and reliable construction.

An even further object of the present invention is to provide a new and improved convertible beach towel and poncho which is susceptible of a low cost of manufacture with regard to both materials and labor, and which accordingly is then susceptible of low prices of sale to the consuming public, thereby making such a convertible beach towel and poncho economically available to the buying public.

Even still another object of the present invention is to provide a new and improved convertible beach towel and poncho for converting a wearable poncho for use as a beach towel for use on a beach.

Lastly, it is an object of the present invention to provide a new and improved convertible beach towel and poncho including a piece of cloth having a circular and essentially planar configuration. The piece of cloth has a large aperture through a central portion thereof. A cover member is also included having a circular and essentially planar configuration. The cover member is dimensioned for removable coupling with the large aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to FIGS. 1 through 5 thereof, the preferred embodiment of the new and improved convertible beach towel and poncho embodying the principles and concepts of the present invention and generally designated by the reference number 10 will be described.

Specifically, it will be noted in the various Figures that the device relates to a convertible beach towel and poncho for converting a wearable poncho for use as a beach towel for use on a beach. In its broadest context, the device consists of a piece of cloth, a cover member, a pillow, a plurality of pouches and a towel. Such components are individually configured and correlated with respect to each other so as to attain the desired objective.

Figure 1:
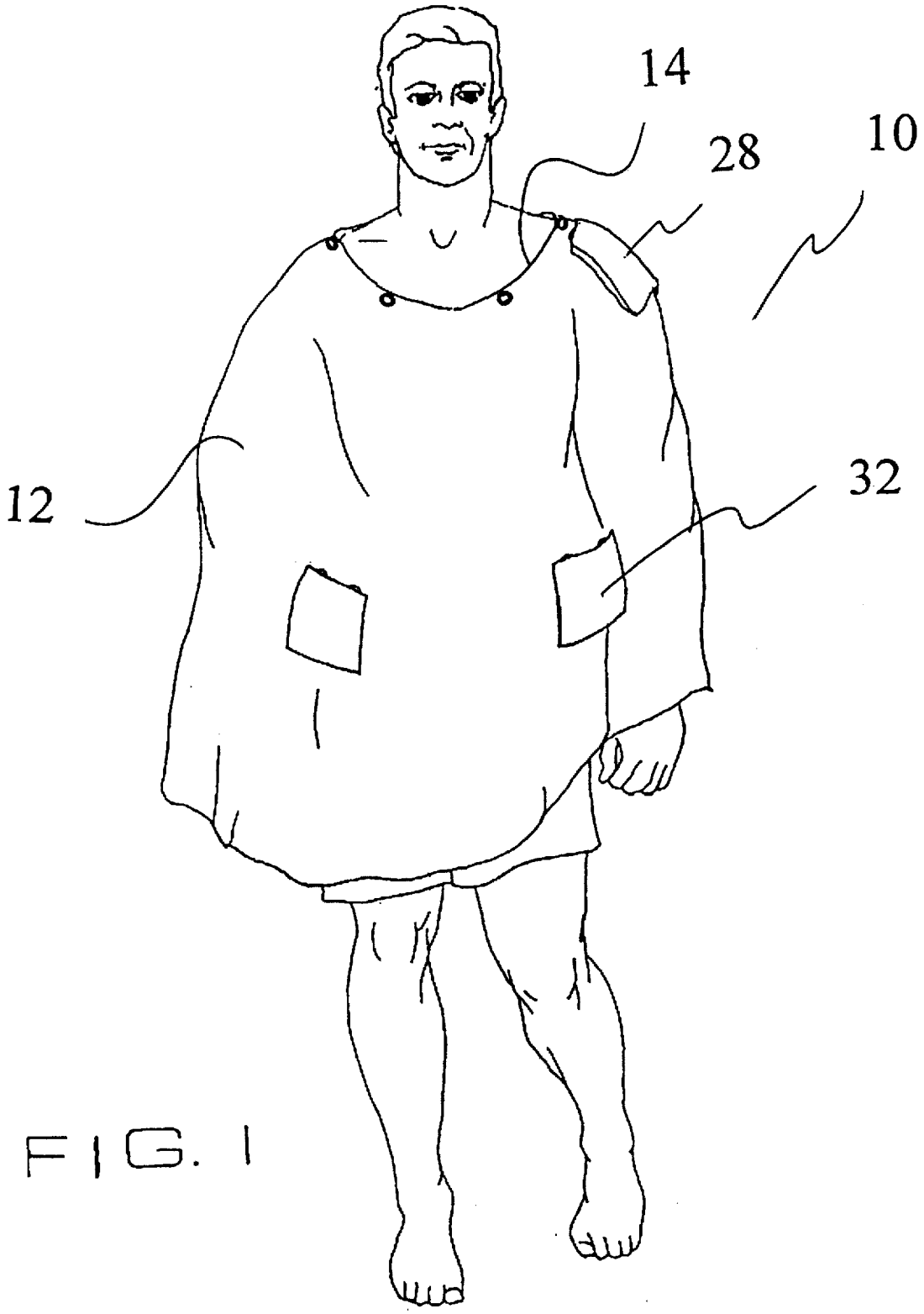
FIG. 1 is a front view of the preferred embodiment of the convertible beach towel and poncho constructed in accordance with the principles of the present invention shown worn on a user.
Figure 2:
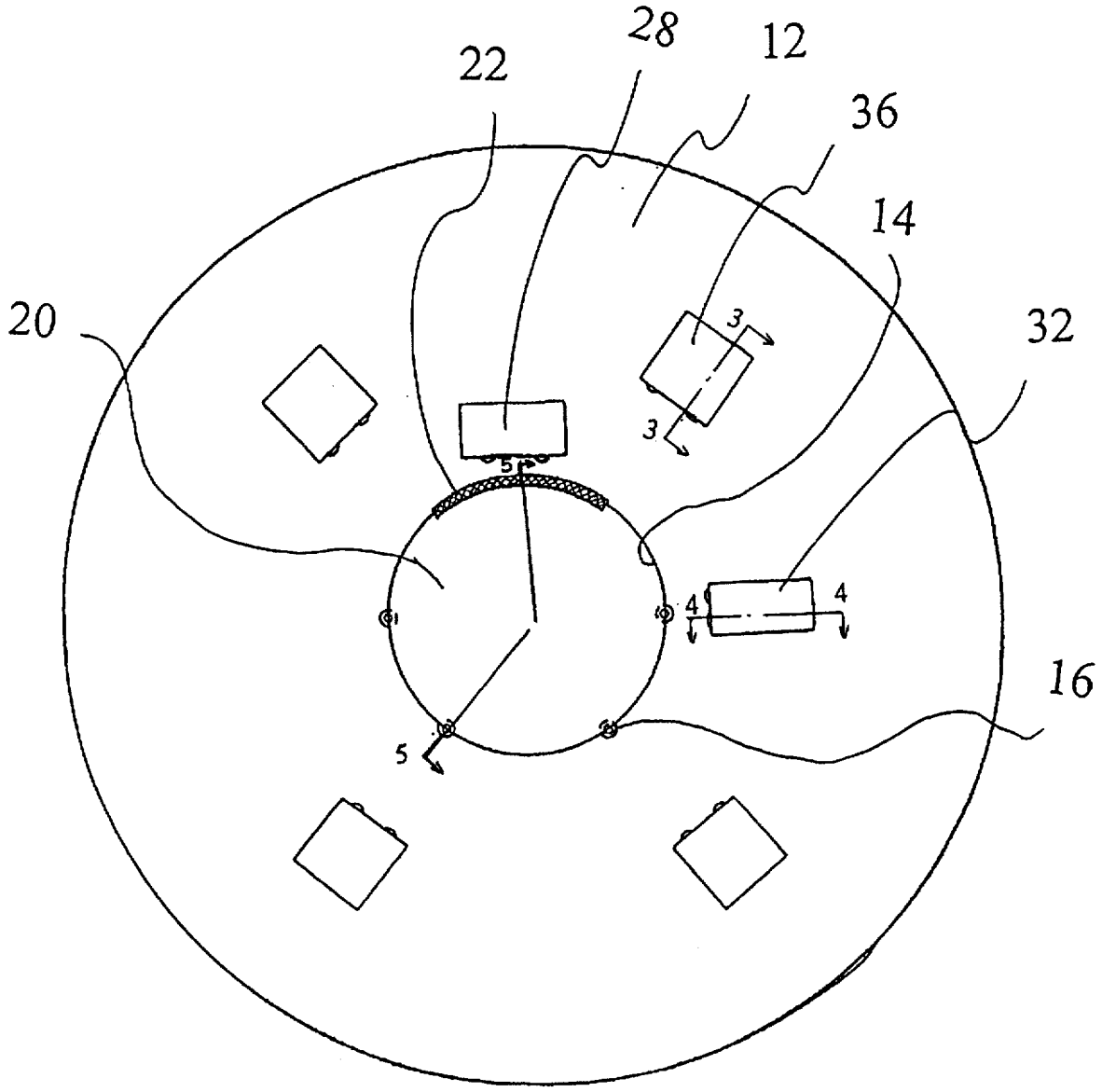
FIG. 2 is a top plan view of the present invention illustrated as the converted beach towel.

The device 10 includes a piece of cloth 12 having a circular and essentially planar configuration. Note FIGS. 1 and 2. The preferred fabrication of the piece of cloth is terry cloth, but other fabrics known in the art of beach towels could be used. The preferred dimension of the piece of cloth includes a diameter of about seventy-four inches. The piece of cloth 12 has an exterior surface and an interior surface. The piece of cloth 12 has a large aperture 14 through a central portion thereof. The large aperture 14 is concentrically positioned with respect to the piece of cloth 12 (Note FIG. 2). The large aperture 14 has a diameter less than ⅕ of a diameter of the piece of cloth 12. The large aperture has a plurality of male snap fasteners 16 disposed around a peripheral edge thereof. The large aperture serves as a head hole for allowing the piece of cloth to be worn as illustrated in FIG. 1.

The device includes a cover member 20 having a circular and essentially planar configuration. The cover member 20 is dimensioned for coupling with the large aperture 14. Note FIG. 2. The cover member has an outer periphery with a segment 22 thereof secured to the peripheral edge of the large aperture 14. Note FIGS. 2 and 5. The outer periphery has a plurality of female fasteners 24 disposed therearound for selective snap engagement with the male snap fasteners 16 of the large aperture 14. The cover member 20 is ideally secured to and covers the large aperture when the device is utilized as the beach towel as in FIG. 2.

A pillow 28 is adapted for removable coupling with the exterior surface of the piece of cloth 12 adjacent to the large aperture 14. The pillow 28 could also be positioned around the piece of cloth and secured thereto by snap fasteners or other means of securement known in the art such as hook and loop fasteners or zipper-type closures.

Figure 3:
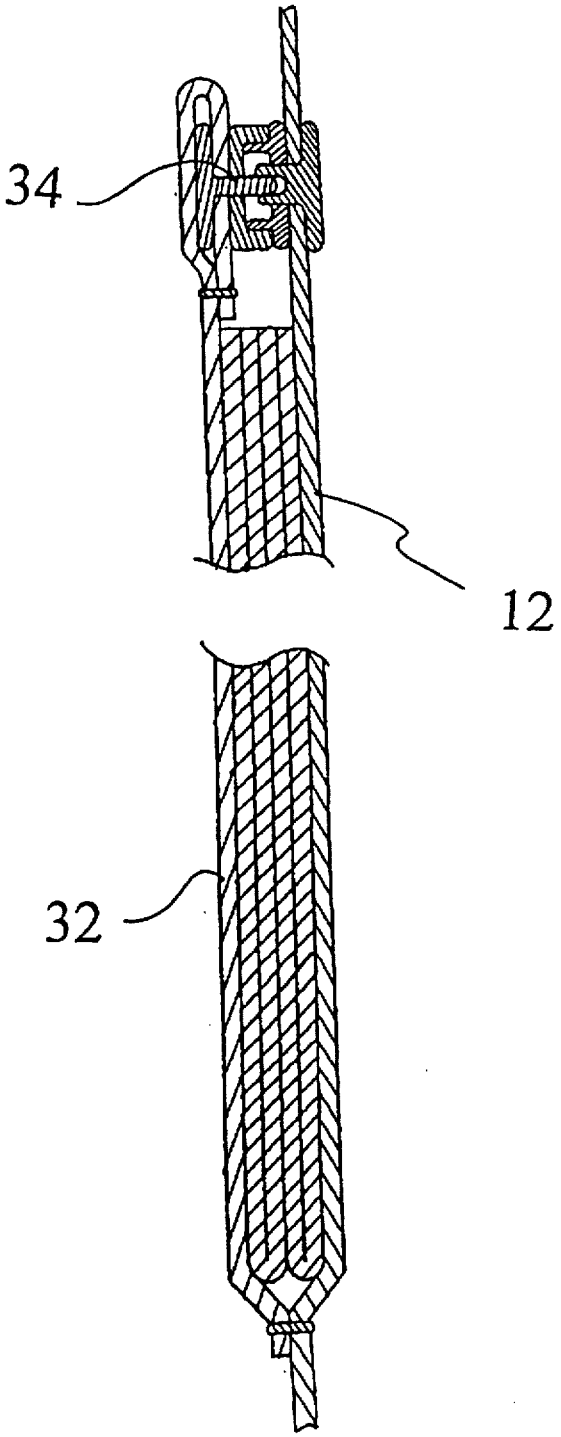
FIG. 3 is a cross-sectional view of the pocket as taken along line 3—3 of FIG. 2.

A plurality of pouches 32 are secured to the exterior surface of the piece of cloth 12. The plurality of pouches 32 are disposed in a spaced relationship around the piece of cloth. Each of the pouches 32 have snap fasteners 34 for selective closure thereof. FIG. 3 illustrates the pouch in use holding an object such as a towel or the like therein. The pouches are positioned around the piece of cloth to carry beach items therein as well as wallets and other personal effects for carrying when the device is utilized as a poncho.

Figure 4:
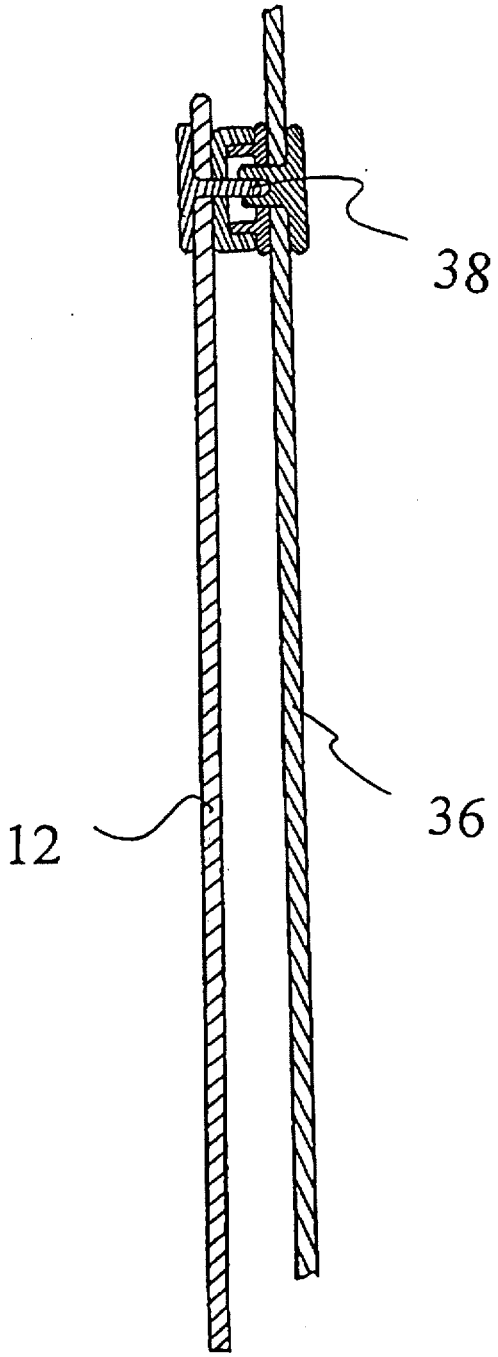
FIG. 4 is a cross-sectional view of the towel as taken along line 4—4 of FIG. 2.
Figure 5:
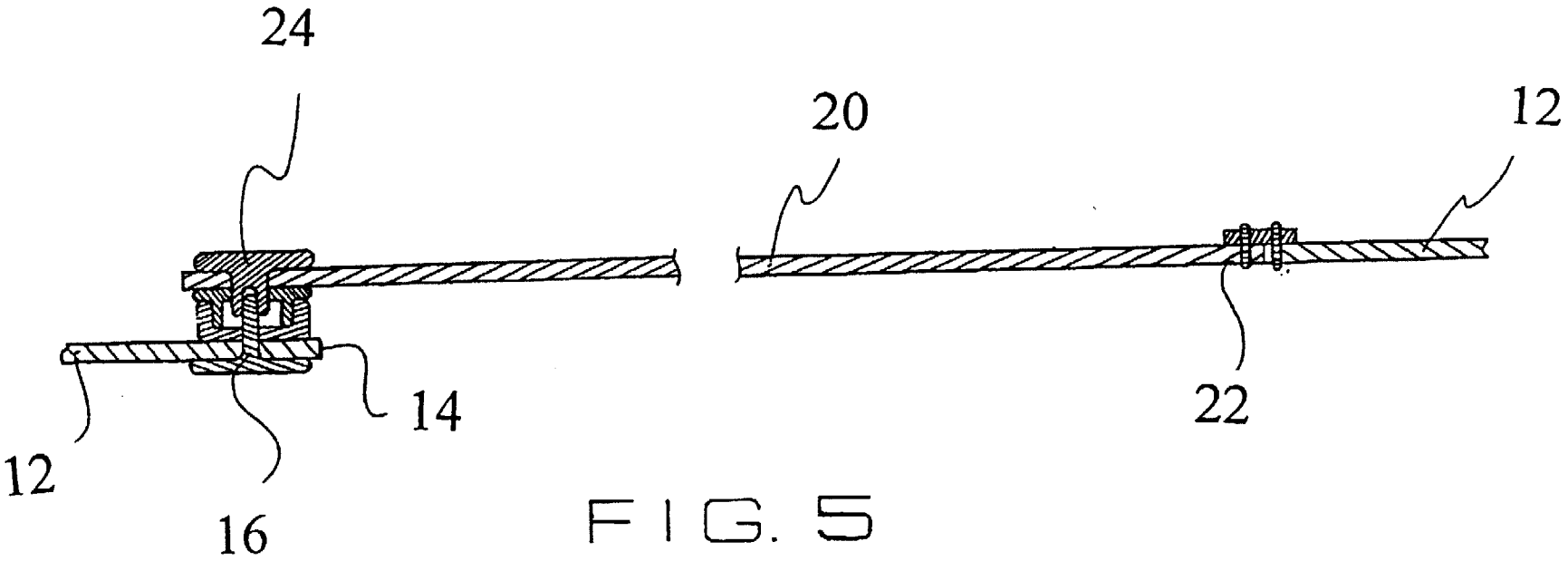
FIG. 5 is a cross-sectional view of the hole cover as taken along line 5—5 of FIG. 2.

Lastly, a towel 36 is provided. The towel 36 is removably secured to the exterior surface of the piece of cloth 2. In the preferred embodiment, as illustrated in FIG. 4, the towel 36 is secured to the piece of cloth via a snap fastener 38.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A convertible beach towel and poncho comprising, in combination:

a piece of cloth having a circular and essentially planar configuration, the piece of cloth having an exterior surface and an interior surface, the piece of cloth having a large aperture through a central portion thereof, the large aperture being concentrically positioned with respect to the piece of cloth, the large aperture having a diameter less than ⅕ of a diameter of the piece of cloth, the large aperture having a plurality of male snap fasteners disposed around a peripheral edge thereof;

a cover member having a circular and essentially planar configuration, the cover member being dimensioned for coupling with the large aperture, the cover member having an outer periphery with a segment thereof secured to the peripheral edge of the large aperture, the outer periphery having a plurality of female snap fasteners disposed therearound for selective snap engagement with the male snap fasteners of the large aperture;

a pillow adapted for removable coupling with the exterior surface of the piece of cloth adjacent to the large aperture;

a plurality of pouches secured to the exterior surface of the piece of cloth, the plurality of pouches being disposed in a spaced relationship around the piece of cloth, each of the pouches having snap fasteners for selective closure thereof; and a towel removably secured to the exterior surface of the piece of cloth.

2. The convertible beach towel and poncho as set forth in claim 1 wherein the piece of cloth is fabricated of terry cloth.

3. A convertible beach towel and poncho comprising, in combination:

a piece of cloth having an exterior surface and an interior surface, the piece of cloth having a large aperture through a central portion thereof, the large aperture having fastening means disposed around a peripheral edge thereof;

a cover member having a circular configuration, the cover member being dimensioned for coupling with the large aperture, the cover member having an outer periphery with a segment thereof secured to the peripheral edge of the large aperture, the outer periphery having fastening means disposed therearound for selective coupling with the fastening means of the large aperture;

a pillow having fastening means adapted for removable coupling with fastening means on the exterior surface of the piece of cloth adjacent to the large aperture;

a plurality of pouches secured to the exterior surface of the piece of cloth, the plurality of pouches being disposed in a spaced relationship around the piece of cloth, each of the pouches having fastening means for selective closure thereof; and a towel removably secured to the exterior surface of the piece of cloth by a fastening means.

* * * * *